US007685833B2

(12) United States Patent
Ju et al.

(10) Patent No.: US 7,685,833 B2
(45) Date of Patent: Mar. 30, 2010

(54) AIR CONDITIONER

(75) Inventors: Jeong Weon Ju, Changwon-si (KR); Kyo Ha Keum, Changwon-si (KR); Yang Mo Son, Masan-si (KR)

(73) Assignee: LG Electronics Inc., Seoul (KR)

( * ) Notice: Subject to any disclaimer, the term of this patent is extended or adjusted under 35 U.S.C. 154(b) by 1177 days.

(21) Appl. No.: 11/151,237

(22) Filed: Jun. 14, 2005

(65) Prior Publication Data

US 2005/0279121 A1 Dec. 22, 2005

(51) Int. Cl.
*F25D 23/12* (2006.01)

(52) U.S. Cl. ..... 62/262; 62/419

(58) Field of Classification Search ..... 62/419, 62/285, 262, 259.2, 244, 298, 408; 165/104.34, 165/48.1

See application file for complete search history.

(56) References Cited

U.S. PATENT DOCUMENTS 5,573,059 A * 11/1996 Hamamoto et al. ..... 165/124
5,575,326 A * 11/1996 Asami et al. ..... 165/124
6,302,783 B1 10/2001 Vroege

FOREIGN PATENT DOCUMENTS

| | | | |
|---|---|---|---|
| CN | 1098492 | A | 2/1995 |
| CN | 1311848 | A | 9/2001 |
| CN | 1195961 | C | 4/2005 |
| EP | 1 087 183 | A1 | 3/2001 |
| GB | 2 360 840 | A | 10/2001 |
| JP | 10-185232 | A | 7/1998 |
| JP | 11-051418 | A | 2/1999 |
| JP | 2003-336860 | A | 11/2003 |
| JP | 2004-138310 | A | 5/2004 |

OTHER PUBLICATIONS

Provided English translation of 2003336860.*

* cited by examiner

*Primary Examiner*—Melvin Jones
(74) *Attorney, Agent, or Firm*—Birch, Stewart, Kolasch & Birch, LLP

(57) ABSTRACT

There is provided an indoor unit of an air conditioner, in which a front part of the indoor unit can be easily assembled and disassembled. The indoor unit includes: a main chassis forming a rear appearance; a front frame disposed at a front of the main chassis to form a front appearance; a heat exchanger disposed between the main chassis and the front frame; a fan for generating airflow through the heat exchanger; a suction grill detachably mounted at a front of the front frame; and a filter disposed at a front of the front frame, for filtering foreign particles from air, wherein the suction grill is fixed to the front frame by an elastic deformation.

16 Claims, 14 Drawing Sheets

AIR CONDITIONER

BACKGROUND OF THE INVENTION

1. Field of the Invention

The present invention relates to an air conditioner, and more particularly, to an indoor unit of an air conditioner, in which a suction grill and a filter provided in a front suction side can be easily attached or detached, and an installation position of the filter is extended, such that an air suction can be performed at wider area, thereby improving the efficiency of the indoor unit.

2. Description of the Related Art

An air conditioner is a device for maintaining optimized inside air according to purpose. For example, in the case where inside air becomes high temperature in summer, the air conditioner blows wind of low temperature to cool down the inside. On the contrary, in winter, the air conditioner blows warm wind of high temperature to heat the inside air.

The air conditioners are roughly divided into an integral type and a separation type. An integral type air conditioner has one unit as a whole and a separation type air conditioner separately has an indoor unit installed inside a space that needs air-conditioning and an outdoor unit installed in the outside. Particularly, recently, a separation type air conditioner is widely used considering noise and installation environment of an air conditioner.

FIG. 1 is an exploded perspective view of a separation type air conditioner of a related art and FIG. 2 is a view illustrating air is sucked into and discharged from an indoor unit of a separation type air conditioner of a related art.

Referring to the drawings, a main chassis 1 forms a frame of an indoor unit. The main chassis 1 has a front panel 3 formed on a front side thereof to form the outer appearance of the indoor unit. The main chassis 1 having the front panel 3 is mounted on a wall in the inside.

A space in which parts that will be described below are mounted is formed between the main chassis 1 and the front panel 3.

In the meantime, the outer appearance of the indoor unit formed by the main chassis 1 and the front panel 3 is protruded toward the front side as a whole as illustrated in FIG. 1.

A suction panel 7 having a front suction grill 5 is provided on the front of the front panel 3 to form a front appearance of the indoor unit. A hinge member (not shown) is provided at the upper end of the suction panel 7 to allow the suction panel 7 to rotate.

The front suction grill 5 is a path through which air sucked from a space that needs air-conditioning is sucked into the inside of the indoor unit. The front suction grill 5 is integrally formed with the suction panel 7. In the meantime, an upper suction grill 3' is formed long left and right on the upper side of the front panel 3. The upper suction grill 3' is integrally formed with the front panel 3 or separately formed.

A heat exchanger 9 is installed at the back of the front panel 3. The heat exchanger 9 allows air sucked through the front suction grill 5 and the upper suction grill 3' to exchange heat while passing through the exchanger 9. A filter 9' for purifying sucked air is installed on the front of the heat exchanger 9.

A cross-flow fan 10 is installed at the back of the heat exchanger. The cross-flow fan 10 sucks air from a space that needs air-conditioning and discharges air back to the space that needs air-conditioning. A fan motor 10' for providing rotational power to the cross-flow fan 10 is installed on the right side of the cross-flow fan 10 and a member for guiding flow created by the cross-flow fan 10 is further integrally formed in the inside of the main chassis 1.

In the meantime, air that has heat-exchanged while passing through the heat exchanger 9 is discharged to a space that needs air-conditioning through the cross-flow fan 10. For that purpose, a discharge grill 11 is installed at the lower end of the main chassis 1 and the front panel 3.

In the meantime, a discharge port 13 for guiding air that has passed through the cross-flow fan 10 to a space that needs air-conditioning is formed in the inside of a discharge grill 11.

A vane 15 for vertically controlling the direction of discharged air and a louver for horizontally controlling the direction of discharged air are installed in the inside of the discharge port 13. The louver 16 is provided in plurals and the louvers 16 are connected to each other by a link 17 to operate simultaneously.

Also, a display part 19 for displaying an operation state of an air conditioner is provided at an about center on the lower portion of the front panel 3.

Description will be made for the air conditioner having the above-described construction and operating in a cooling mode.

When the air conditioner operates, air for air-conditioning is sucked into the inside of an indoor unit by the cross-flow fan 11. That is, air is sucked into the inside of the indoor unit through the front suction grill 5 and the upper suction grill 3' to pass through the heat exchanger 9.

The air that has passed through the heat exchanger 9 exchanges heat with working fluid (refrigerant) flowing in the inside of the heat exchanger 9.

The air that has exchanged heat with the heat exchanger 9 becomes relatively low temperature and is sucked into the cross-flow fan 10. The air sucked into the cross-flow fan 10 is discharged to the lower direction and guided to the side of the discharge port 13.

The air guided to the inside of the discharge port 13 changes a discharging direction thereof using the vane 15 and the louver 16 installed inside the discharge port 13 and is discharged to a space that needs air-conditioning through the discharge grill 13. At this point, since the vane 15 and the louver 16 allow the discharged air to be distributed vertically and horizontally, the air is uniformly discharged to the space that needs air-conditioning.

To fix the heat exchanger 9, a fixing bracket 8 is provided to the left of the main chassis 1 and a fixing end 8' that corresponds to a screw-coupling end 9*a* of the heat exchanger 9 is provided to the right of the main chassis 1. A screw-coupling hole 8" should be punched in the inside of the fixing end 8'.

A receiving groove 8*a* for receiving a left end of the heat exchanger 9 is formed on the front side and the upper side of the fixing bracket 8. Hookers 8*b* for hooking and fixing a left hair pin 9*c* of the heat exchanger 9 are protruded in the inside of the receiving groove 8*a*.

A screw through hole 9*b* that corresponds to the screw-coupling hole 8" is punched in the inside of the screw-coupling end 9*a* of the heat exchanger 9.

The heat exchanger 9 is fixed by fixing the fixing bracket 8 in the left of the main chassis 1 using a screw S. At this point, the receiving groove 8*a* of the fixing bracket 8 is open toward the right side.

When the hair pin 9*c* of the heat exchanger 9 is inserted into the receiving groove 8*a* of the fixing bracket 8, the hair pin 9*c* is hooked at and fixed in the hooker 8*b* of the inside of the receiving groove 8*a*. At this point, the left end of the heat exchanger 9 is fixed first.

After that, the right side of the heat exchanger 9, more specifically, the screw-coupling end 9*a* is closed attached to the fixing end 8' of the main chassis 1 and the screen through hole 9*b* is coupled to the screw-coupling hole 8" using a screw S, so that the heat exchanger 9 is fixed to the main chassis 1.

However, the related art has the following problems.

The upper suction grill 3' and the front suction grill 5 are installed independently of the front frame 3. The filter 9' is also installed separately. Therefore, when the indoor unit is assembled or disassembled for cleaning, a lot of working time is necessary. Also, installation of the suction grills 3' and 5 are difficult.

The suction of air occurs only at the front, or the front or upward. However, this construction is difficult to suction air in three-dimensional way, so that air circulation in the indoor space is not smooth.

SUMMARY OF THE INVENTION

Accordingly, the present invention is directed to an indoor unit of an air conditioner that substantially obviates one or more problems due to limitations and disadvantages of the related art.

An object of the present invention is to provide an indoor unit of an air conditioner, which is capable of easily attaching and detaching a suction grill to and from a front frame.

Another object of the present invention is to provide an indoor unit of an air conditioner, in which a filter and a suction grill are coupled together such that they can be easily detachable as one body, thereby increasing user and operator's convenience.

A further another object of the present invention is to provide an indoor unit of an air conditioner, which is capable of sucking an outdoor air flowing into the indoor unit from all directions and capable of perfectly performing a filtering operation on the sucked air.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an indoor unit of an indoor unit of an air conditioner, including: a main chassis forming a rear appearance; a front frame disposed at a front of the main chassis to form a front appearance; a heat exchanger disposed between the main chassis and the front frame; a fan for generating airflow through the heat exchanger; a suction grill detachably mounted at a front of the front frame; and a filter disposed at a front of the front frame, for filtering foreign particles from air, wherein the suction grill is fixed to the front frame by an elastic deformation.

In another aspect of the present invention, there is provided an indoor unit of an air conditioner, including: a main chassis forming a rear appearance; a front frame disposed at a front of the main chassis to form a front appearance; a heat exchanger disposed between the main chassis and the front frame; a fan for generating airflow through the heat exchanger; a suction grill detachably mounted at a front of the front frame; and a filter disposed at a front of the front frame, for filtering foreign particles from air, the filter being fixed to a rear of the suction grill.

In a further aspect of the present invention, there is provided an indoor unit of an air conditioner, including: a main chassis having a rear suction hole through which air is introduced from a rear side; a front frame disposed at a front of the main chassis to form a front appearance; a heat exchanger disposed between the main chassis and the front frame; a fan for generating airflow through the heat exchanger; a suction grill detachably mounted at a front of the front frame; and a filter disposed at a front of the front frame, for filtering foreign particles from air, the filter being fixed to a rear of the suction grill.

According to the present invention, the suction grill can be easily attached or detached, so that the cleaning and the working efficiency of the after service are improved. Since the suction grill and the filter are attached simultaneously, the disassembling and assembling operations can be performed more conveniently. Also, since an outdoor air is introduced from all directions, the usage efficiency of the indoor can be improved much more.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
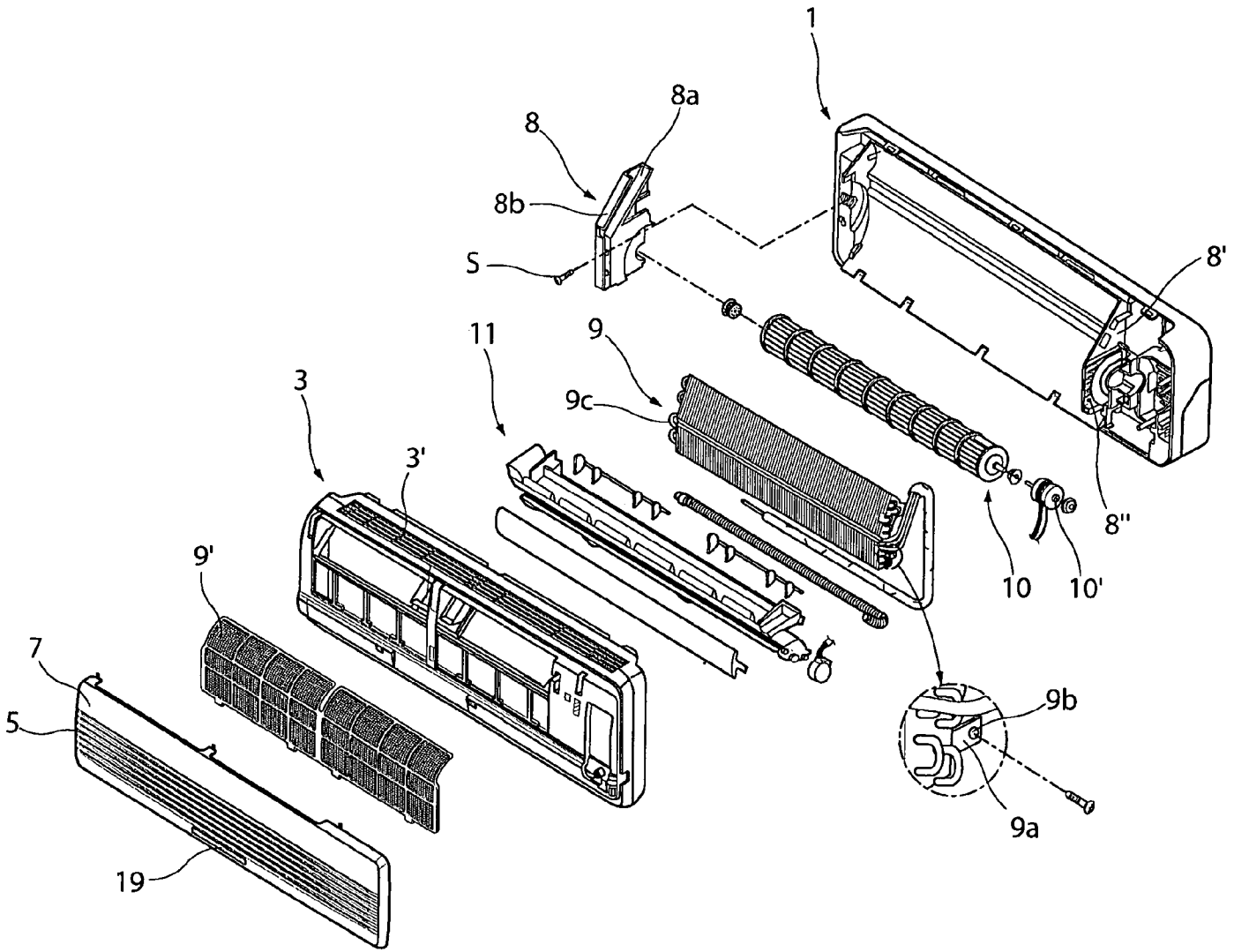
FIG.1(Related art)
FIG. 1 is an exploded perspective view of an indoor unit of an air conditioner of a related art.
Figure 2:
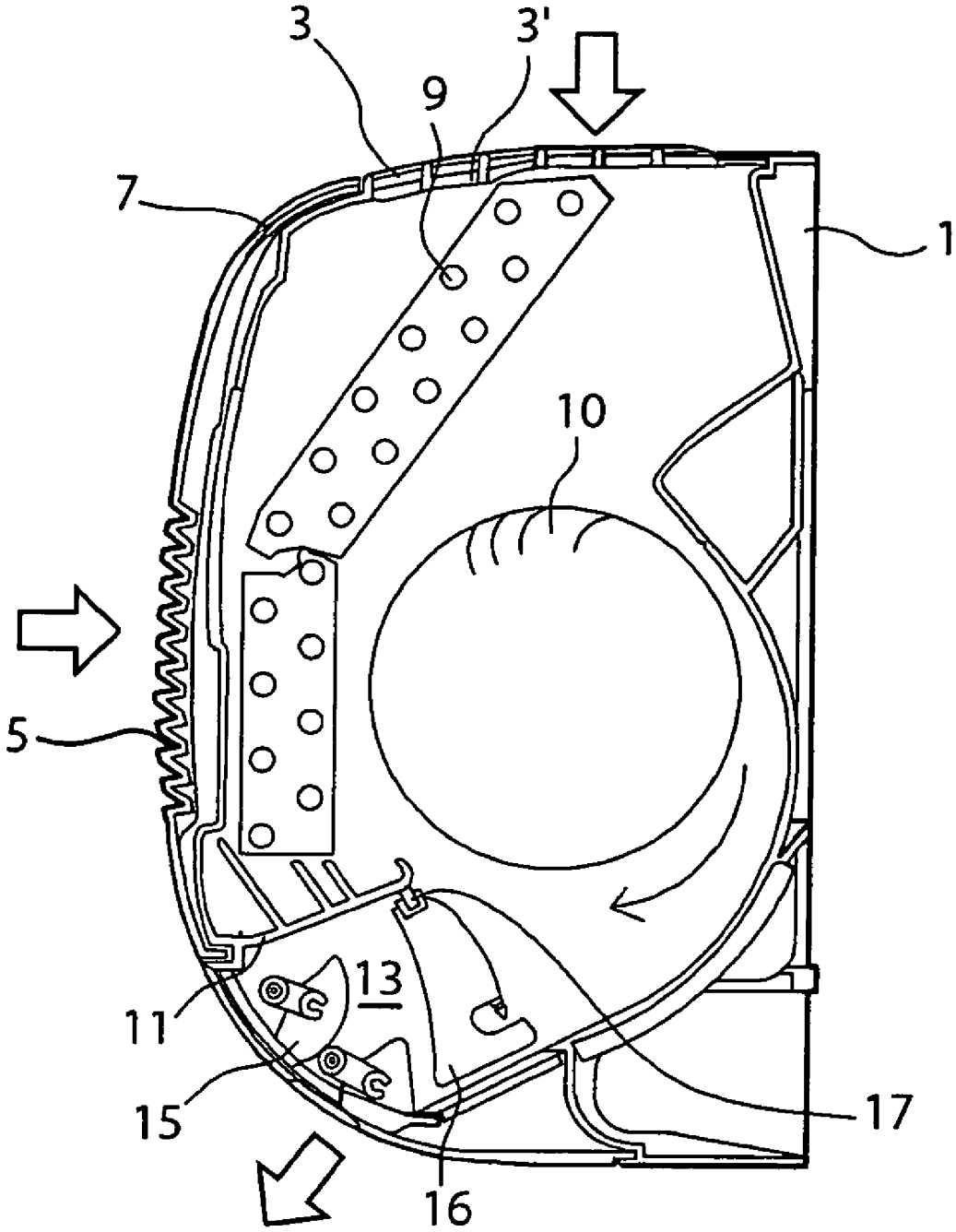
FIG.2(Related art)
FIG. 2 is a side view illustrating an air flow in an indoor unit of an air conditioner of a related art.
Figure 3:
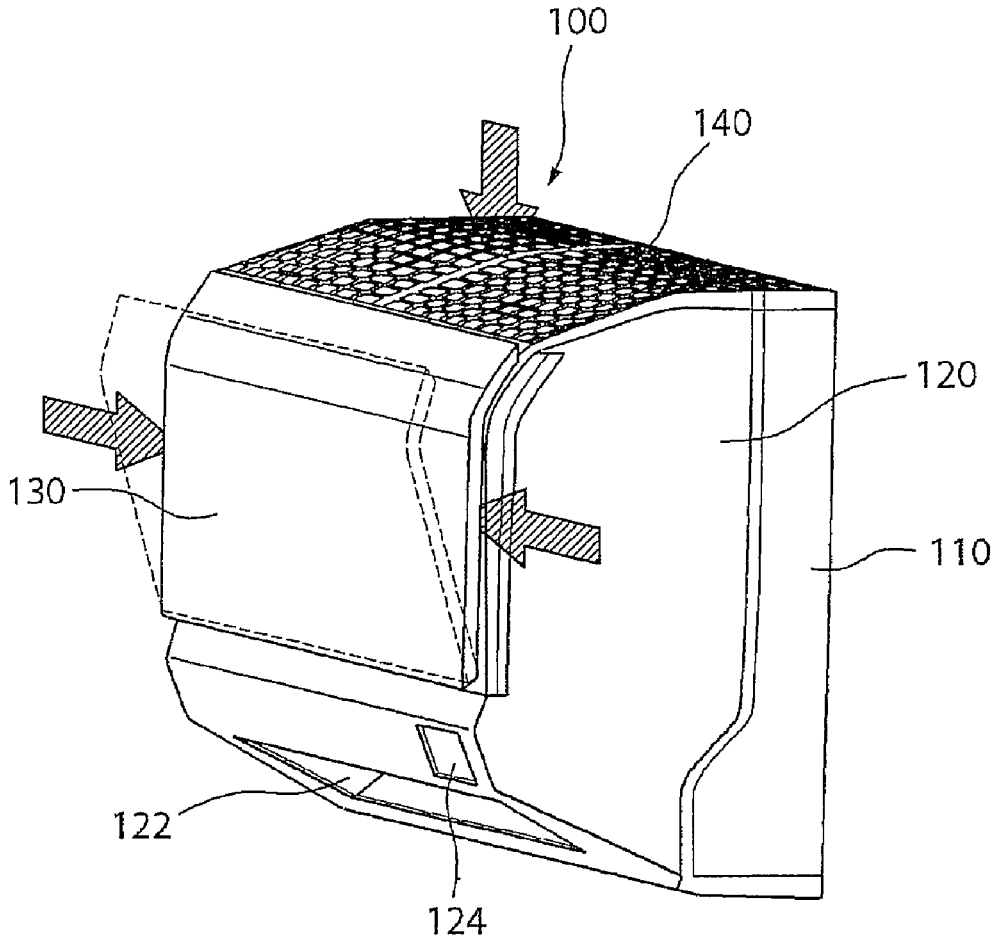
FIG. 3 is a perspective view of an indoor unit of an air conditioner according to a preferred embodiment of the present invention.

FIG. 3 is an exploded perspective view of an indoor unit of an air conditioner according to a preferred embodiment of the present invention. Referring to FIG. 3, the indoor unit of the air conditioner includes a main chassis 110 and a front frame 130, which constitute a whole appearance. The main chassis 110 defines a whole frame and forms a back appearance, and the front frame 120 is disposed at the front of the main chassis 110 to form a front appearance.

The front of the front frame 120 is shielded by a front panel 130. A suction grill 140 is formed on an upper side of the front panel 130, that is, an upper surface of the front frame 120. Preferably, the front panel 130 is spaced apart from the front frame 120 by a predetermined distance. Accordingly, an outdoor air is introduced through a gap between the front panel 130 and the front frame 120. Meanwhile, the front panel 130 can be installed to be rotatable around a lower portion by a predetermined angle.

A discharge hole 112 is formed at a lower portion of the front frame 120. Accordingly, the air introduced into the indoor unit through the discharge hole 122 is again discharged to the outside. A discharge grill 200, which will be described later, is provided inside the discharge hole 122.

A display window 124 is disposed at a right upper side of the discharge hole 122. The display window 124 is transparent such that the user can verify operation states of the indoor unit 100, which are displayed on the display device (not shown) of the discharge grill 200.

Figure 4:
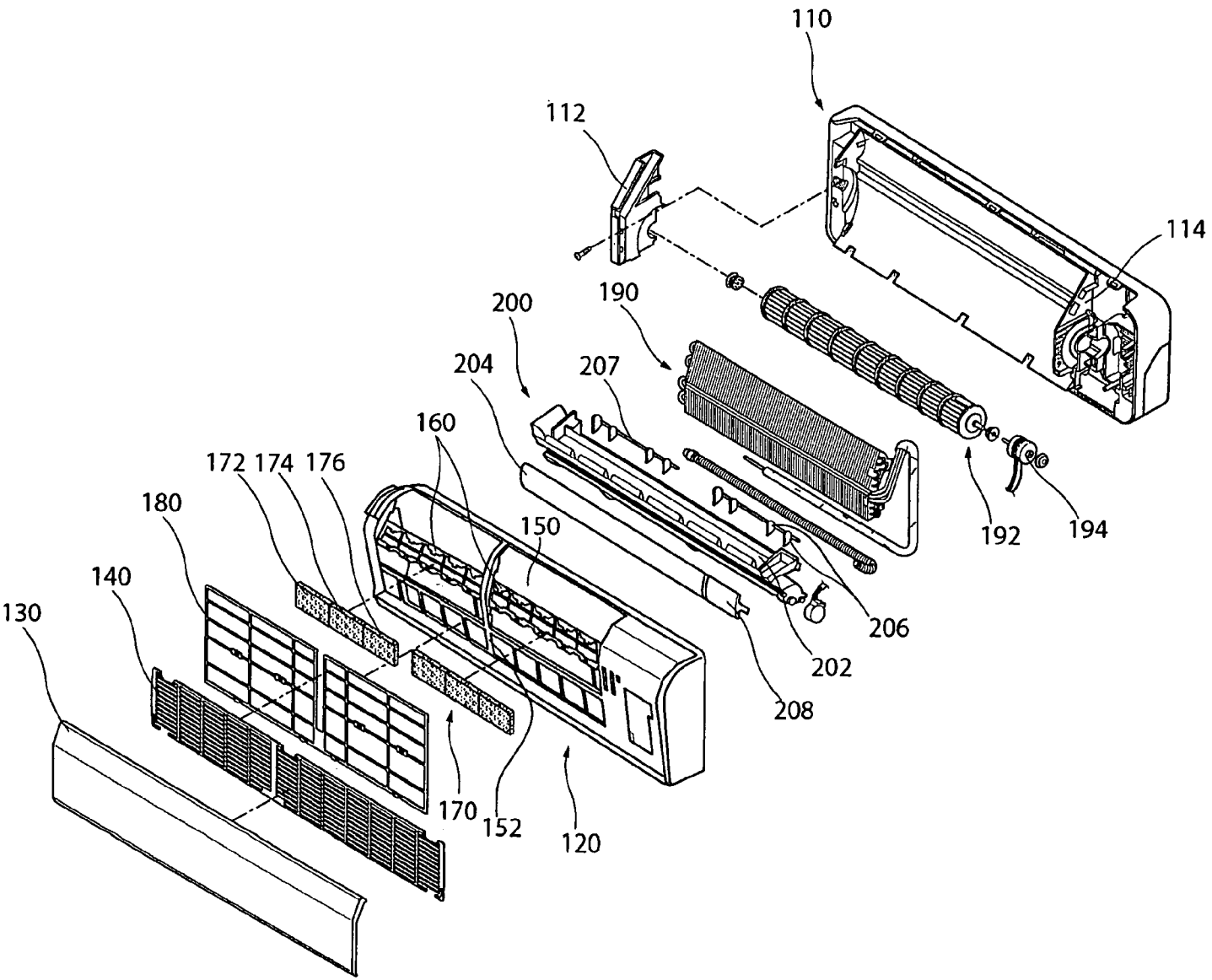
FIG. 4 is an exploded perspective view of an indoor unit of an air conditioner according to the present invention.

FIG. 4 is an exploded perspective view of a separation type air conditioner according to the present invention. The indoor unit 100 of the separation type air conditioner will be described below in detail with reference to FIG. 4.

Referring to FIG. 4, a whole appearance of the indoor unit 100 is defined by a main chassis 110 and a front frame 120. The main chassis 110 is mounted on an indoor wall.

A space where a plurality of parts will be mounted is defined between the main chassis 110 and the front frame 120. The appearance of the indoor unit is protruded forwards as shown in FIG. 4.

At a left end portion of the main chassis 110, a fixing bracket 112 is provided to fix a heat exchanger 190 and a left end of a cross-flow fan 192. At a right end portion of the main chassis 110, a fixing part 114 is protruded forwards to fix the heat exchanger 190 and a right end of the cross-flow fan 192.

A suction hole 150 is formed at the front of the front frame 120. The suction hole 150 serves as a passage through which air is introduced from the outside of the indoor unit 100. Here, filter frames 160 are formed at the left and right. A high-performance filter 170, which will be described later, is mounted on the filter frames 160, and the filter frames 160 are provided in pair provided at the left and right. That is, a central separation member 152 crosses a central portion of the suction hole 150 up and down, and the filter frames 160 are provided at the left and right of the central separation member 152.

The high-performance filter 170 is mounted on the filter frame 160. The high-performance filter 170 can have single or multiple functions. For example, the filter 170 includes an ammonia deodorizing filter 172 for deodorizing clouds of smoke or various smells, a formaldehyde deodorizing filter 172 for deodorizing harmful components generated from building materials, and a toluene (VOC) deodorizing filter 176 for deodorizing smells of volatile organic materials.

The suction grill 140 serves as a passage through which air is introduced into the indoor unit 100 in the space for the air conditioning. The suction grill 140 is installed to surround an upper portion of the suction hole 150 of the filter frame 160. The suction grill 140 is mounted on the front frame 120, while it is connected with a pre-filter 180 in one body.

The pre-filter 180 is installed between the front panel 130 and the front frame 120. The pre-filter 180 filters foreign particles in air and entirely surrounds the suction hole 150. That is, the pre-filter 180 is elastic and covers an area ranging the rear upper portion of the front frame 120 as well as the front portion of the front frame 120.

A heat exchanger 190 is installed at the rear of the front frame 120. The heat exchanger 190 exchanges heat of the air sucked through the suction grill 140. Preferably, the heat exchanger 190 is bent many times corresponding to the suction hole 150 of the front frame 120.

A cross-flow fan 192 is installed at the rear of the heat exchanger 190. The cross-flow fan 192 sucks air from the space for the air conditioning and discharges the sucked air to the space for the air conditioning. That is, the cross-flow fan 192 controls the airflow such that it sucks an outdoor air through the suction hole 150 and discharges the air through the discharge hole 122.

A fan motor 194 for providing a torque to the cross-flow fan 192 is installed at the right of the cross-flow fan 192. Preferably, the front surface of the main chassis 110 has a curvature corresponding to an outer periphery of the cross-flow fan 192 such that air current generated by the cross-flow fan 10 is easily guided.

A discharge grill 200 is provided at an lower inner side of the front frame 120. A discharge passage 202 is formed in the discharge grill 200 such that the air heat-exchanged in the indoor unit 100 is guided to be discharged to the outside.

A vane 204 for controlling an up/down direction of air discharged through the discharge passage 202 and a louver 206 for controlling a left/right direction thereof are installed in the discharge grill 200. Here, a plurality of louvers 206 are provided, and the plurality of louvers 206 are connected together by a link and thus are operated at the same time.

An auxiliary vane 208 is further provided at the right of the discharge grill 200 to control an air discharge direction together with the vane 204. A motor (not shown) is further provided at one side of the auxiliary vane 208 to control the rotation of the auxiliary vane 208 according to the usage states of the air conditioner. A display device (not shown) is disposed at an upper portion of the auxiliary vane 208 to display a variety of information on the operation states of the air conditioner.

Figure 5:
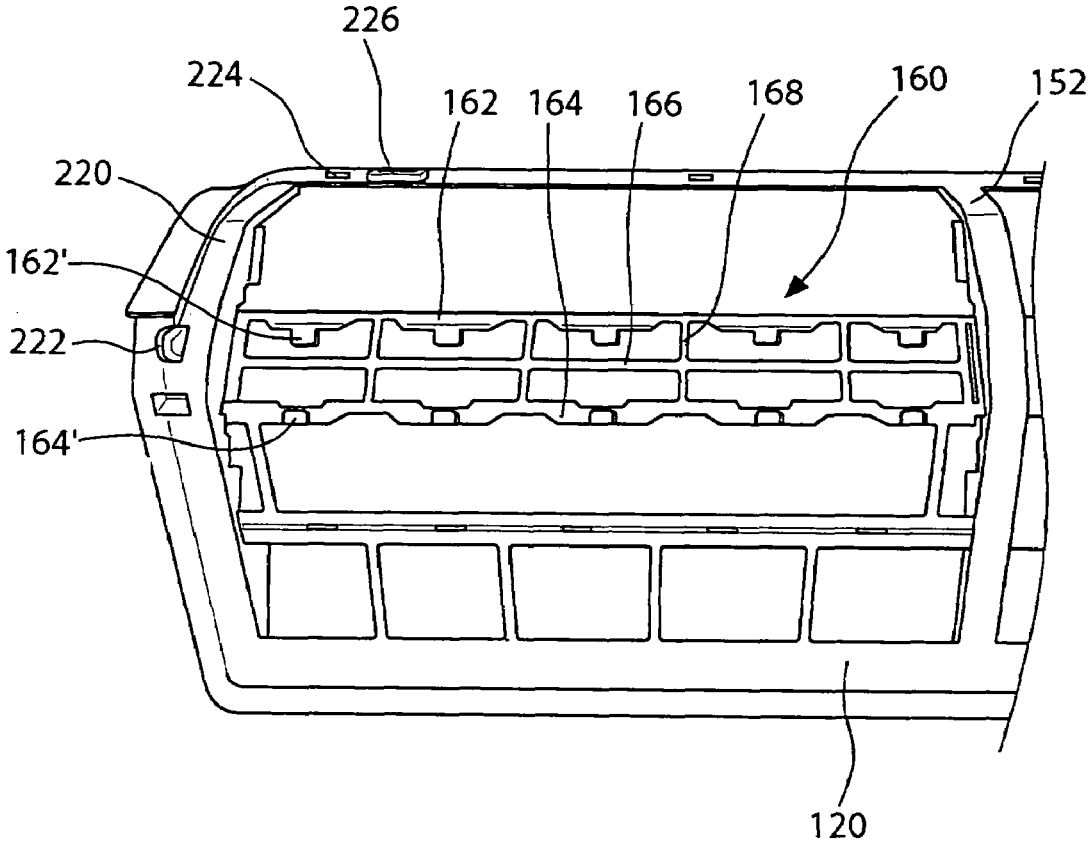
FIG. 5 is a perspective view of a front frame according to the present invention.

FIG. 5 is a perspective view of the front frame shown in FIG. 4. A construction of the front frame 120 will be described below in more detail with reference to FIG. 5.

Referring to FIG. 5, the filter frame 160 is disposed elongated left and right at the central portion of the suction hole 150 of the front frame 120. An upper support 162 supports an upper portion of the high-performance filter 170 and a lower support 164 supports a lower portion of the high-performance filter 170. Also, a central support 170 is disposed between the upper support 162 and the lower support 164. The central support 164 contacts with the rear surface of the high-performance filter 170. Meanwhile, the upper support 162, the central support 166 and the lower support 164 are connected together by a plurality of connection ribs 168 formed up and down at predetermined intervals.

A portion of the upper support 162 is protruded forwards. A front end of the protrusion is bent downward to thereby form a fixing protrusion 162'. Accordingly, a front upper portion of the high-performance filter 170 is latched to the fixing protrusion 162'. Meanwhile, a lower protrusion 164' spaced apart by a predetermined distance is protruded forwards from the lower support 164 and supports a lower portion of the high-performance filter 170.

Sliding support surfaces 220 are defined at left and right ends of the front frame 120. The sliding support surfaces 220 are formed to be recessed rearwards from the front surface of the front frame 120. Both ends of the suction grill 140 are received in the sliding support surfaces 220 and are slidingly supported.

A connection groove 222 is further formed at a side of the sliding support surface 220. The connection groove 222 is recessed in a left direction. A connection protrusion 246 of the suction grill 140, which will be described later, is inserted and fixed to the connection protrusion 222.

A plurality of upper fixing holes 224 and a plurality of connection holes 226 are formed in an upper portion of the front frame 120, that is, an upper portion of the suction hole 150. An upper fixing protrusion 232 of the suction grill 140, which will be described later, is inserted into the upper fixing holes 224 and the connection holes 226.

Figure 6:
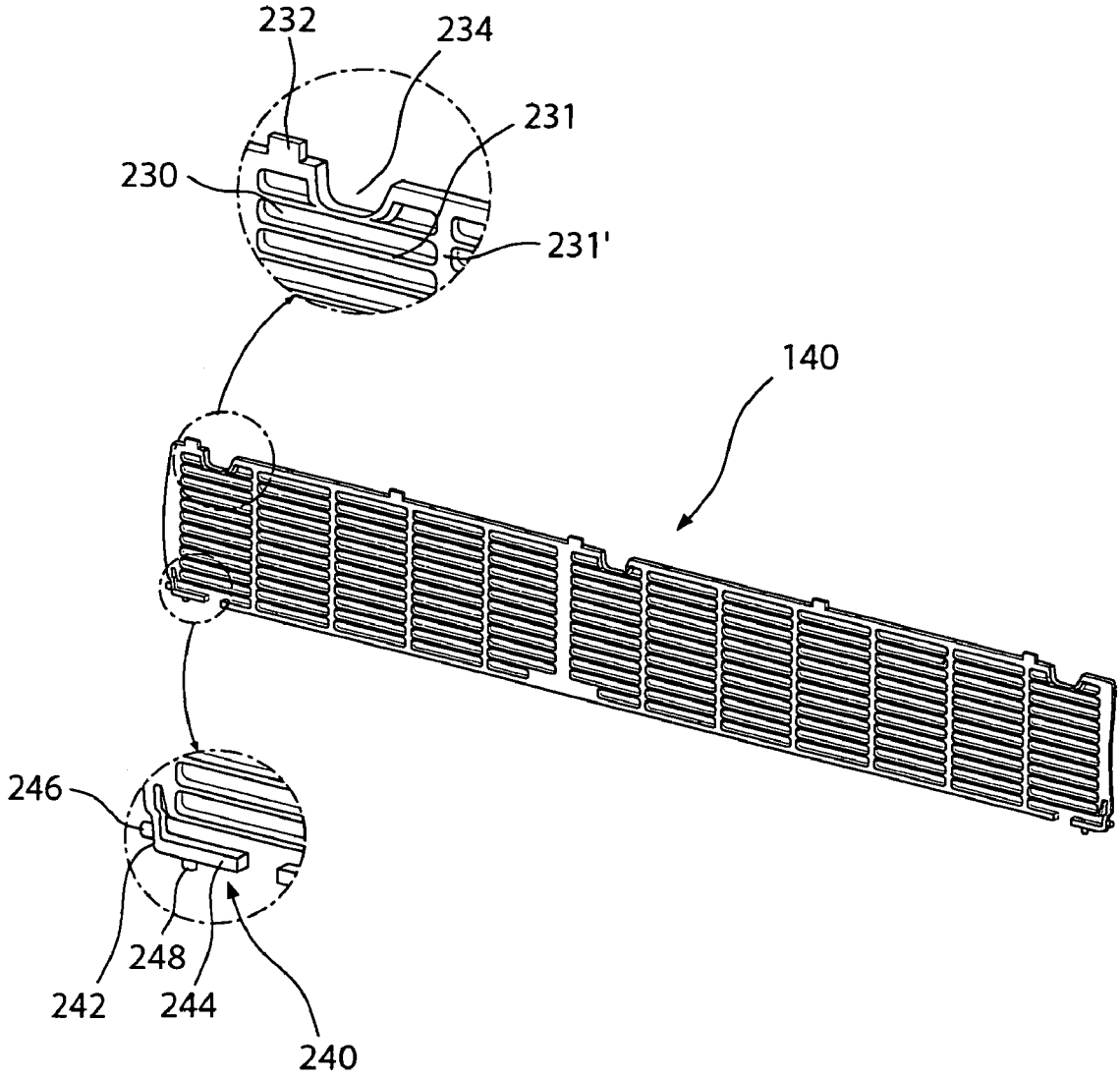
FIG. 6 is a perspective view of a suction grill according to the present invention.

FIG. 6 is a perspective view of the suction grill. A construction of the suction grill 140 will be described below in detail with reference to FIG. 6.

A plurality of air through holes 230 are formed in the suction grill 140 to guide a suction of an outdoor air. A plurality of the upper fixing protrusion 232 are protruded upward. In an inside of the suction grill 140, a plurality of left/right ribs 231 crossing in left/right direction are intersected with a plurality of up/down ribs 231'. The air through holes 230 are formed between the left/right ribs 231 and the up/down ribs 231', such that air can pass therethrough.

The shape and the number of the upper fixing protrusion 232 correspond to those of upper fixing protrusion 224 of the front frame 120. Accordingly, if the upper fixing protrusion 232 of the suction grill 140 is inserted into the upper fixing hole 224 of the front frame 120, the upper portion of the suction grill 14.0 is fixed.

A plurality of connection hole receiving grooves 234 are formed at the upper portion of the front frame 120. Accordingly, if the suction grill 140 is mounted on the front frame 120, the connection hole 226 of the front frame 120 is placed at the connection hole receiving grooves 234, thereby preventing the mutual interference between the front frame 120 and the suction grill 140.

A connection rib 240 is formed on both lower sides of the suction grill 140. The connection rib 240 may be a detachable unit that allows the suction grill 140 to be detached to the front frame 120.

The connection rib 240 is provided by cutting a lower portion of the suction grill 140. That is, the connection rib 240 is formed on both sides of the suction grill 140. The connection rib 240 of the left side has a "⌊" shape and the connection rib 240 of the right side has a "⌋" shape.

The connection rib 240 includes a support 242 extending downward from both ends of the suction grill 140, and a guide part 244 vertically bent laterally from the lower portion of the support 242. Accordingly, the connection rib 240 has a predetermined elasticity due to its shape and a portion of the connection rib 240 can be bent left and right with respect to the upper portion of the support 242.

The connection protrusion 246 is protruded laterally at the side of the support 242. The connection protrusion 246 is inserted into the connection groove 222 of the front frame 120. Meanwhile, a guide protrusion 248 is protruded downward from the lower portion of the guide part 244. The guide protrusion 248 prevents a sliding when user's fingers contact with the guide part 244.

Meanwhile, although the suction grill 140 seems to be straight vertically, it is actually bent with a predetermined angle or curvature. Accordingly, the suction hole of the front frame 120 can be covered entirely.

An operation of the indoor unit of the air conditioner according to the present invention will be described below.

Once the air conditioner is operated in a cooling mode, an air flows into the inside of the air conditioner by the cross-flow fan 192. That is, the fan motor 194 operates and produces a rotational power by a voltage applied from the outside. The cross-flow fan 192 rotates by this rotational power. An outdoor air flows into the indoor unit of an air conditioner 100 through the suction grill 140 when the cross-flow fan 192 rotates.

The outdoor air flowing into the in the indoor unit 100 passes though the heat exchanger 190. The air passing through the heat exchanger 190 is cooled down by a refrigerant running the inside of the heat exchanger 190.

The heat-exchanged air in the heat exchanger 190 becomes the relatively low temperature air and flows into the cross-flow fan 192. The low temperature air flowing into the cross-flow fan 192 is discharged in a cylindrical direction of the cross-flow fan 192 and guided into the bottom compartment.

The guided air passes through the discharge port 202 of the discharge grill 200. At this time, the air is discharged into the space for an air conditioning by the vain 204 and the louver 206 installed in the inside of the discharge port 202.

The case where the suction grill 140 is attached and detached to the front frame 120 will be described below reference to FIGS. 7 to 9.

Figure 7:
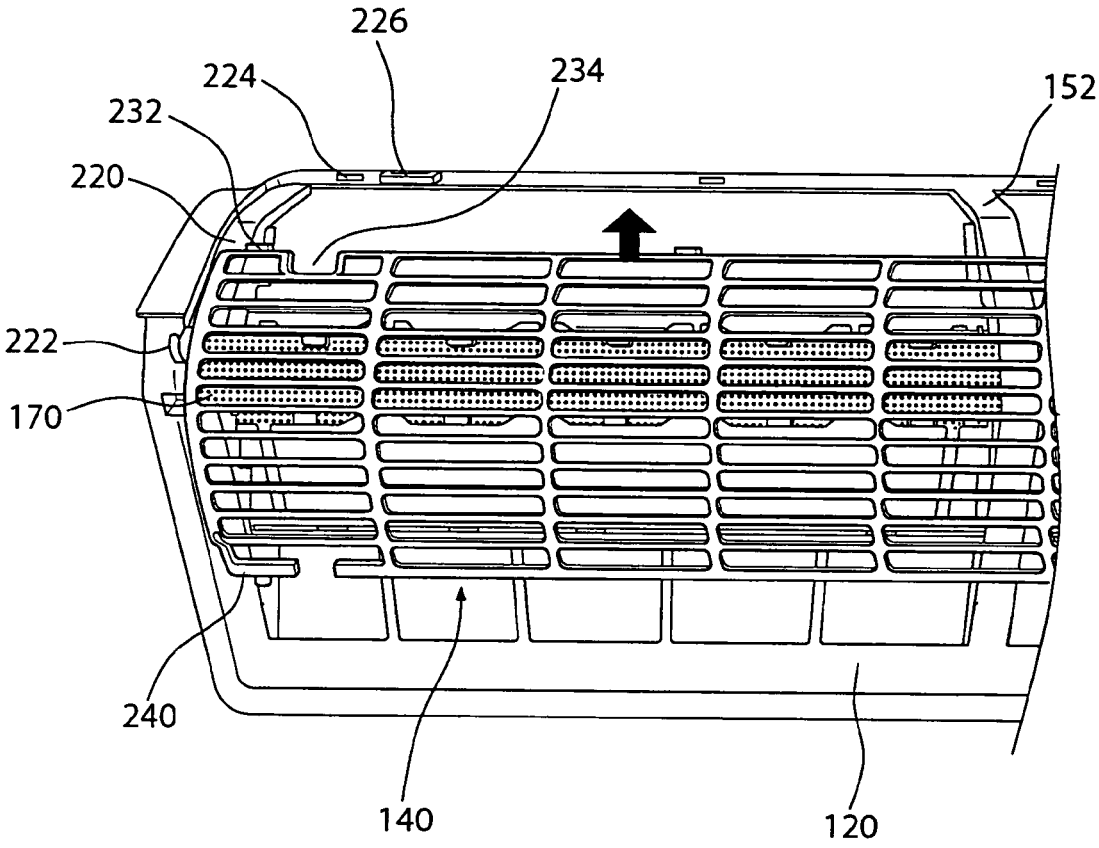
FIG. 7 is a view illustrating an operation of installing a suction grill according to the present invention.

FIG. 7 is a view illustrating an operation of installing a suction grill according to the present invention.

Referring to FIG. 7, since the sliding support surface 220 of the front frame 120 has a curvature corresponding to the suction grill 140, the suction grill 140 is closely attached from the front to the central portion of the front frame 120. In this case, both sides of the suction grill 140 is closed attached to the sliding support surface 220 and pushes the suction grill 140 upward. An arrow indicates the movement direction of the suction grill 140.

When the suction grill 140 slides upward and reaches the upper portion of the suction hole 150, the upper fixing protrusion 232 of the suction grill 140 is inserted into the upper fixing hole 224 of the front frame. Accordingly, the upper portion of the suction grill 140 is fixed and the connection hole receiving groove 234 is received in the connection hole 226.

Meanwhile, as the suction grill 140 slides upward along the sliding support surface 220, the connection protrusion 246 of the connection rib 240 comes in contact with the side of the sliding support surface 220. Accordingly, the inner left portion of the connection rib 240 is bent in a right direction, and the right portion of the connection rib 240 is bent in a left direction.

When the upper portion of the suction grill 140 reaches the upper portion of the suction hole 150, the connection protrusion 246 of the connection rib 240 is inserted into the connection groove 222 by the elastic force of the connection rib 240. In this case, the lower portion of the suction grill 140 is fixed to the front frame 120. In of the above, the connection rib 240 is elastically deformed while the suction grill 140 moves along front frame 120.

The suction grill 140 can be disassembled in the reverse order. FIG. 9 is a view illustrating an operation of disassembling the suction grill according to the present invention.

Figure 8:
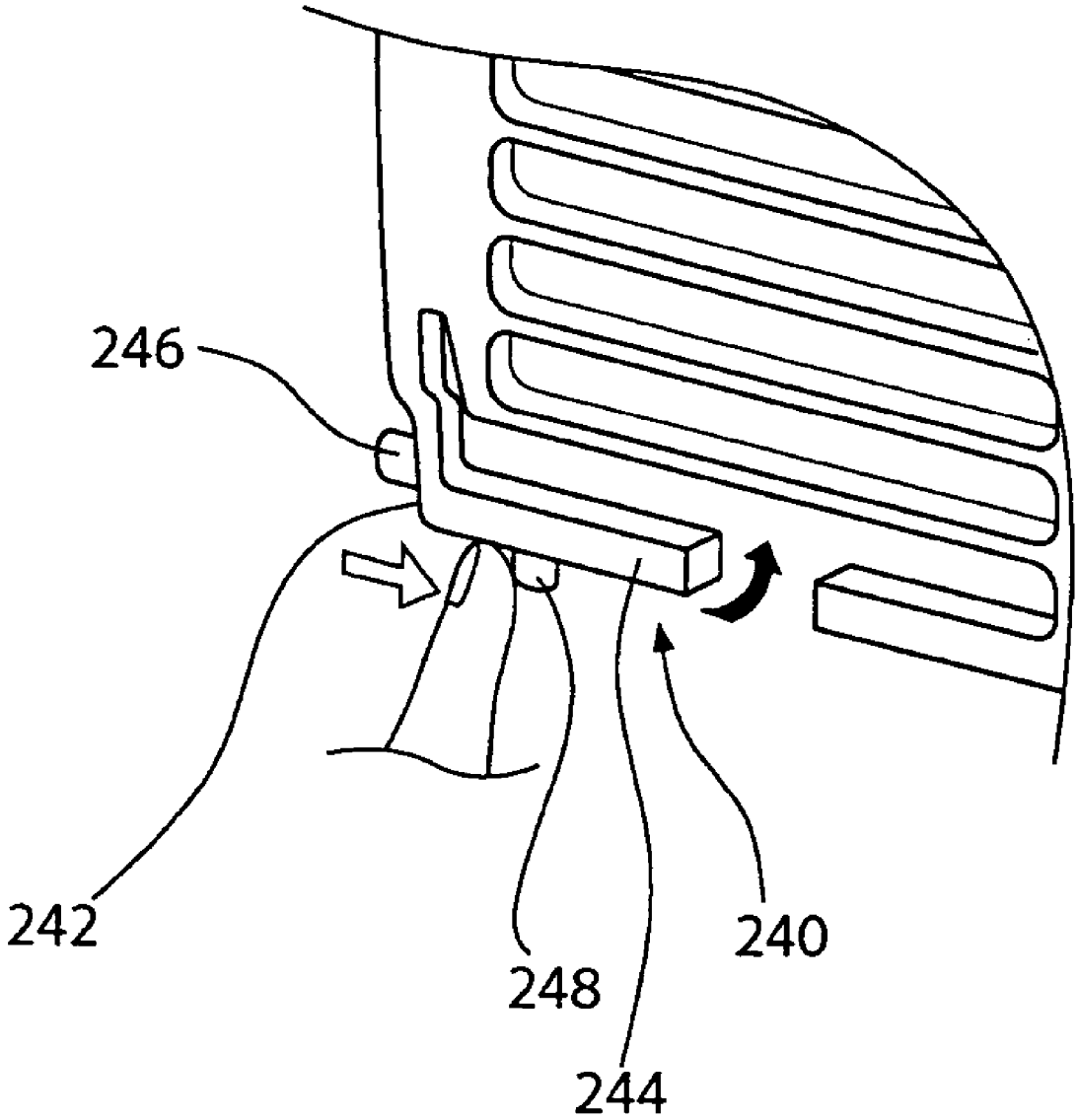
FIG. 8 is a view illustrating a manipulation of a suction grill.
Figure 9:
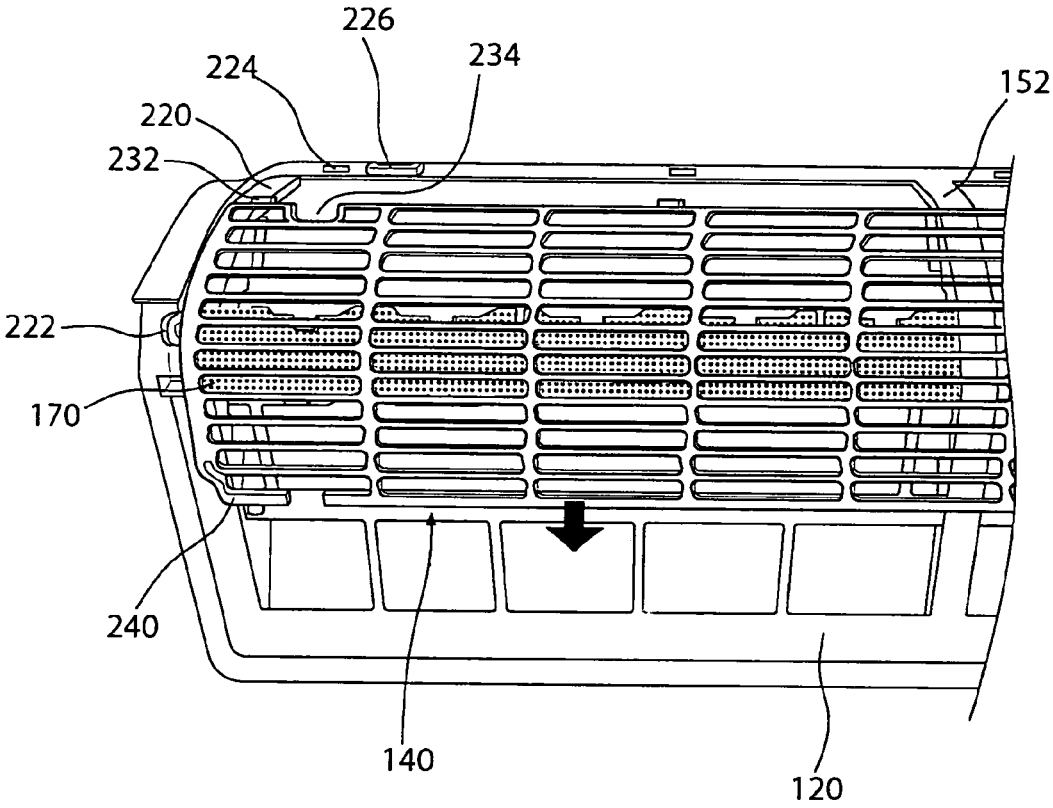
FIG. 9 is a view illustrating an operation of disassembling a suction grill according to the present invention.

As shown in FIG. 8, when the suction grill 140 is mounted on the front frame 120, the lower portion of the connection rib 240 is moved in one direction (the right direction in FIG. 8, hereinafter the description will be made with reference to FIG. 8) using the user's fingers. In more detail, the fingers contact with the guide protrusion 248 of the connection rib 240 and apply a force in the right direction.

In this case, the lower portion of the connection rib 240 moves in the right direction by its own elasticity. At this time, the connection protrusion 246 escapes from the connection groove 222 of the front frame 120.

When the connection protrusion 246 is disassembled from the connection groove 222, the suction grill 140 is pulled downward. Both sides of the suction grill 140 slides downward along the sliding support surface 220 of the front frame 120, and the upper fixing protrusion 232 of the suction grill 140 is completely disassembled from the upper fixing hole 224. Accordingly, the suction grill 140 is completely disassembled from the front frame 120.

Meanwhile, the suction grill 140 is combined with the filter 180 as one body and is received in the front frame 120. This allows the user to assemble and disassemble the suction grill 140 conveniently. A structural correlation between the suction grill 140 and the filter 180 will be described below.

Figure 10:
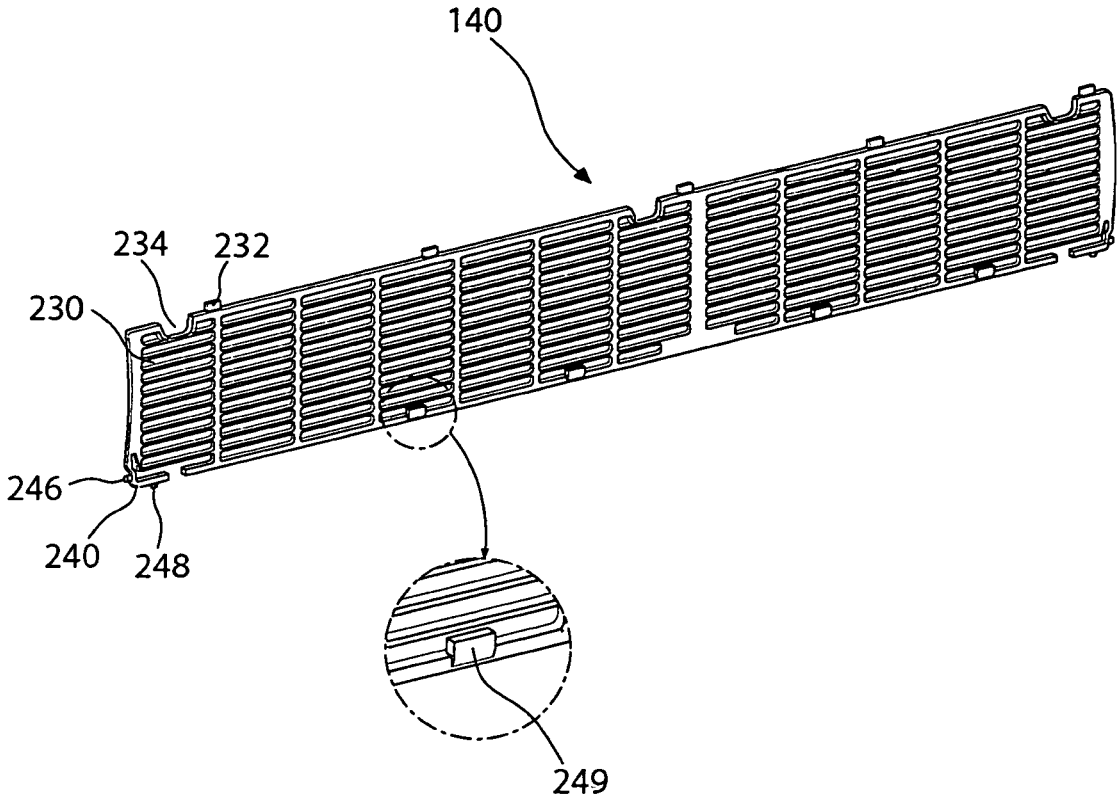
FIG. 10 is a perspective view of a suction grill according to the present invention.

FIG. 10 is a rear perspective view of the suction grill. Referring to FIG. 10, the connection rib 240 and the upper fixing protrusion 232 are constructed such that the suction grill 140 can be fixed to the front frame 120 in itself. A plurality of connection protrusions 249 are formed at the rear lower portion of the suction grill 140.

The connection grill 249 is protruded rearward and connected to the connection ring 184.

Figure 11:
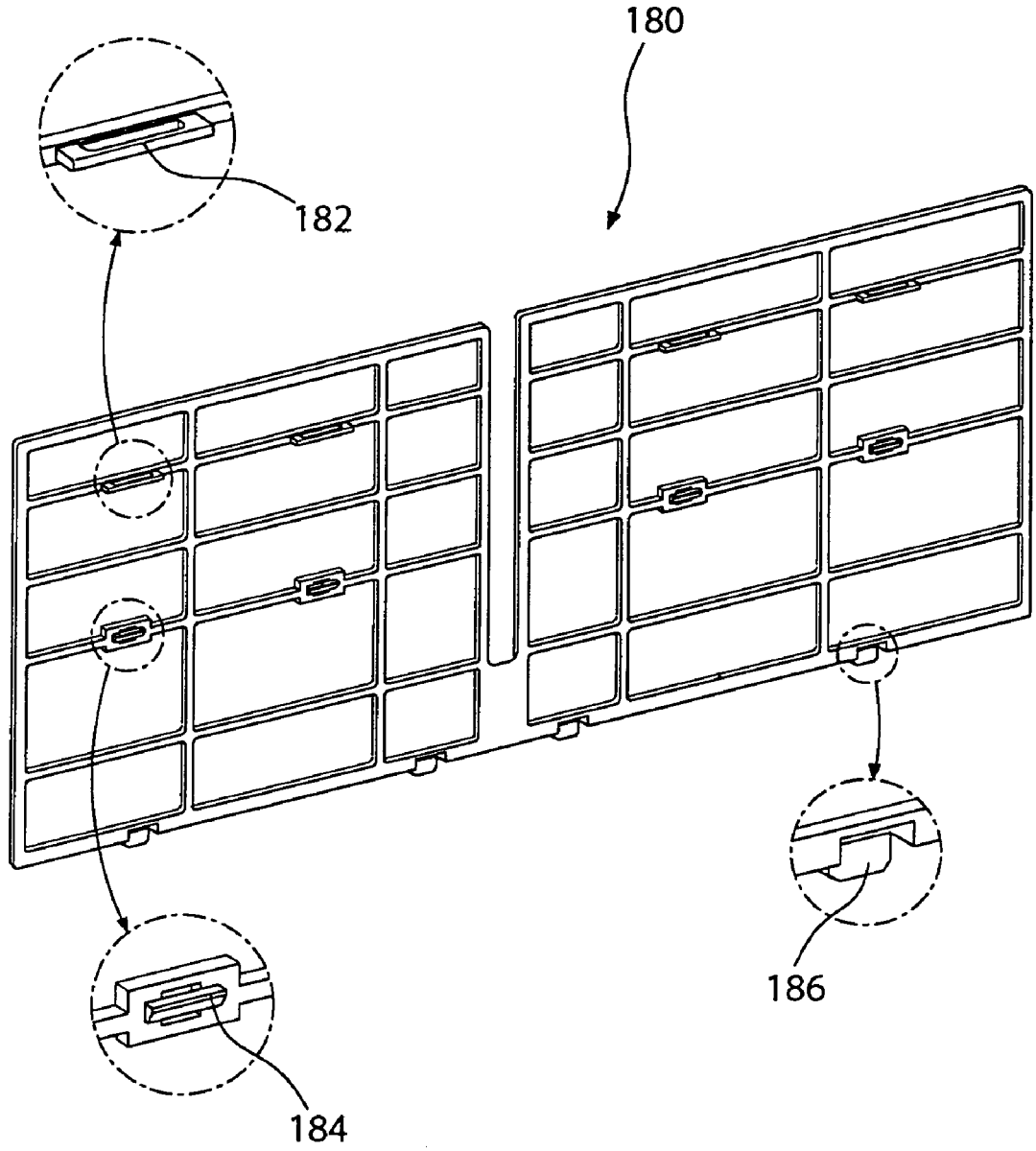
FIG. 11 is a perspective view of a filter according to the present invention.

FIG. 11 is a perspective view of the filter.

Referring to FIG. 11, the filter 180 includes a plurality of locking protrusions 182 to which the left/right rib 231 of the suction grill 184 is locked. A connection ring 184 is formed below from the locking protrusion 182 by a predetermined distance. The connection protrusion 0249 of the suction grill 140 is latched to the connection ring 184. Accordingly, the suction grill 140 is connected to the filter 180 by the locking protrusion 182 and the connection ring 184.

A lower rib 186 is further formed at a lower portion of the suction grill 140 and is latched to the front frame 120. A portion of the lower rib 186 is protruded rearward and bent downward. Accordingly, one end of the front frame 120, more particularly the lower portion of the suction hole 150, is disposed a space between the lower rib 186 and a lower portion of the suction grill 140. The filter 180 filters foreign particles from air sucked through the suction hole 150.

Figure 12:
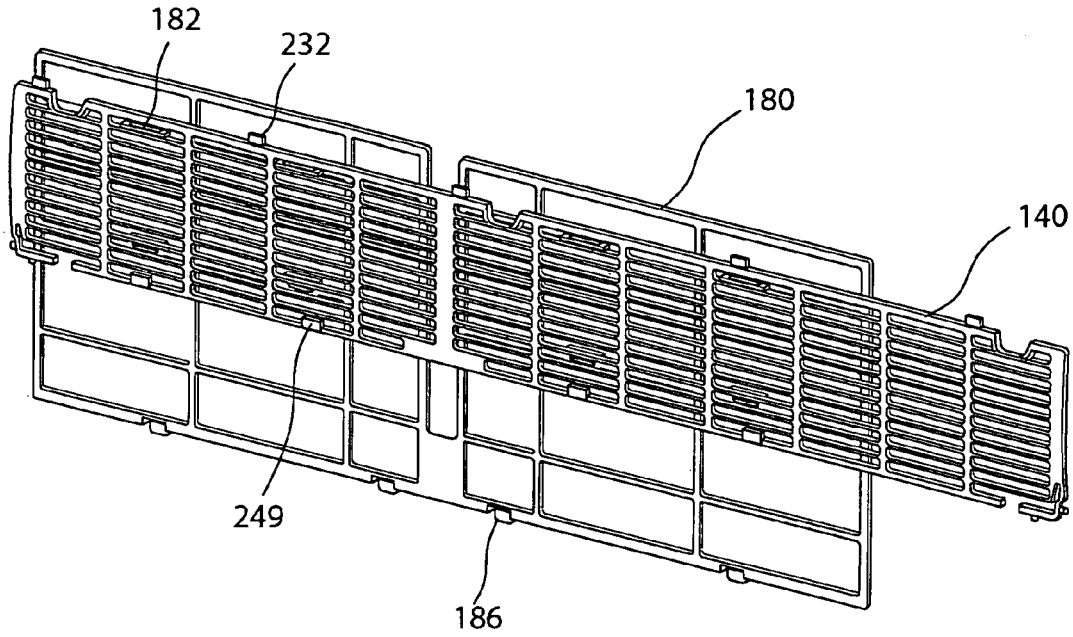
FIG. 12 is a view illustrating a connection of a suction grill and a filter.

FIG. 12 is a view illustrating a connection of the suction grill and the filter.

Referring to FIG. 12, when the suction grill 140 and the filter 180 are mounted on the front frame 120, the suction grill 140 and the filter 180 are assembled in one body and simultaneously mounted on the front frame 120. Accordingly, first, the filter is fitted into the suction grill 140. That is, as shown in FIG. 12, the filter 180 is closely attached from the rear of the suction grill 140.

At this time, the connection protrusion 249 of the suction grill 140 is latched to the connection ring 184 of the filter 180. The upper left/right rib 231 of the suction grill 140 is closely attached to the bottom surface of the locking protrusion 182 of the filter 180. Since the filter 180 is elastic, it is overlapped with the suction grill 140 such that its central portion is roundly protruded forward.

Meanwhile, the filter 180 extends up to the front surface of the main chassis 110, such that it can filter the air sucked from the main chassis, that is, the rear of the indoor unit.

In order for the filter to smoothly perform the filtering operation, the filter is configured to be elastic and is divided into a plurality of parts. In more detail, the filter includes a front part 181, an upper part 183, and a rear part 185. The upper part 181 filters foreign particles from air sucked through a gap between the front frame 120 and the front panel 130. The upper part 183 is bent at the upper portion of the front part 181 and filters foreign particles from air sucked through the suction grill 140. The rear part 185 filters foreign particles from air sucked through the rear suction hole 116 of the main chassis, which will be described below. The filter 180 is installed to cover the area including the upper and lower portions of the main chassis 110 as well as the front frame 120.

Figure 13:
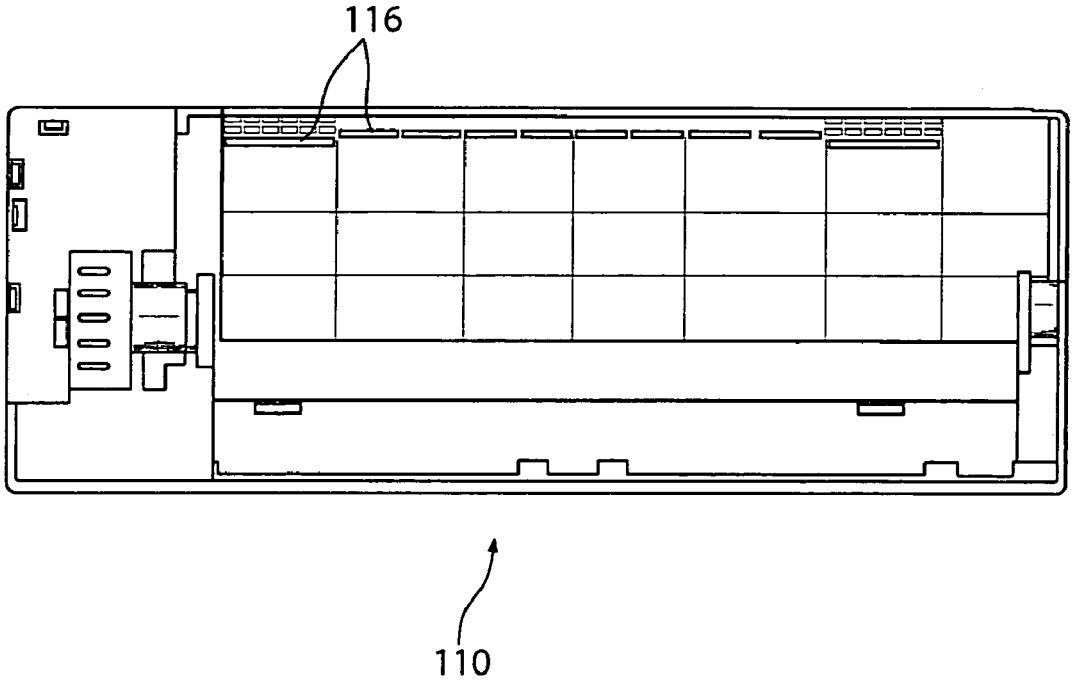
FIG. 13 is a rear view of an indoor unit according to the present invention.

FIG. 13 is a rear view of the indoor unit according to the present invention.

In FIG. 13, the rear side of the main chassis 110 is illustrated in detail. Referring to FIG. 13, the rear surface of the main chassis 110 is flat and is attached on the wall. Preferably, the rear surface of the main chassis 110 and the wall are spaced apart from each other by a predetermined distance.

A rear suction hole 116 is formed at the upper portion of the main chassis 110. The rear suction hole 116 serves as a passage through which air sucked from the rear of the main chassis 110 is guided inside. A plurality of rear suction holes 116 are provided left and right. Of course, air sucked through the rear suction hole 116 is filtered by the filter 180.

Figure 14:
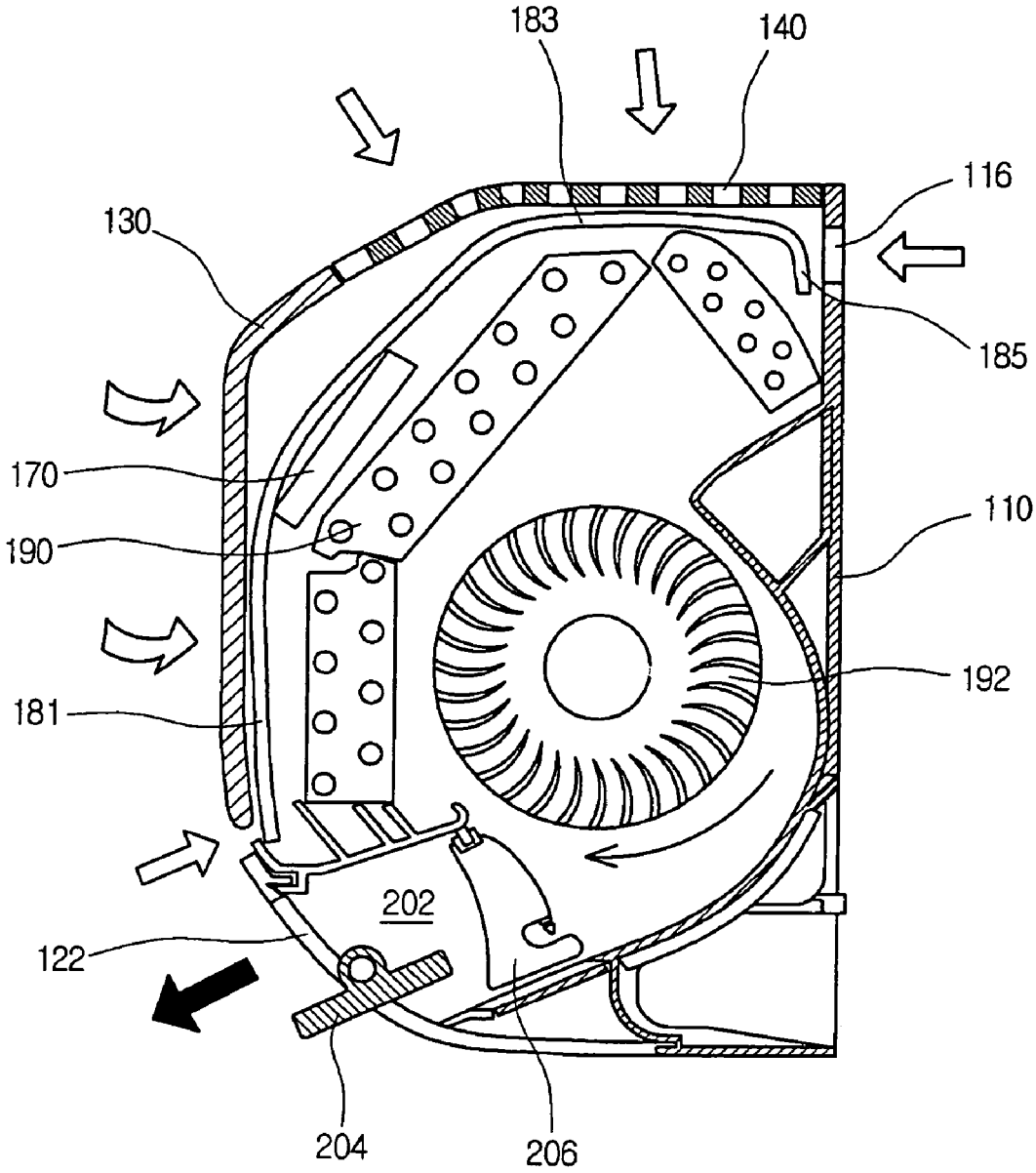
FIG. 14 is a cross-sectional view of an air conditioner according to the present invention.

FIG. 14 is a cross-sectional view of the air conditioner according to the present invention. A flow direction of air will be described with reference to FIG. 14.

Once the air conditioner is operated, an air flows into the inside of the air conditioner by the cross-flow fan 192. That is, the fan motor 194 operates and produces a rotational power by a voltage applied from the outside. The cross-flow fan 192 rotates by this rotational power. An outside air flows into the indoor unit of an air conditioner 100 through the suction grill 140 when the cross-flow fan 192 rotates.

When the cross-flow fan 192 rotates, the suction force is generated. The air that is introduced from the upper portion of the indoor unit and filtered by the upper part 183 of the filter, the air that is introduced through the gap between the front panel 130 and the front frame 120 and filtered by the front part 181 of the filter, and the air that is introduced through the rear suction hole 116 of the main chassis 110 and filtered by the rear part 185 of the filter flow into the indoor unit 100.

The outdoor air flowing into the indoor unit 100 is filtered while passing through the filter 180 and the high-performance filter 180, and then passes through the heat exchanger 190. The air passing through the heat exchanger 190 is cooled down by a refrigerant running the inside of the heat exchanger 190.

The heat-exchanged air in the heat exchanger 190 becomes the relatively low temperature air and flows into the cross-flow fan 192. The low temperature air flowing into the cross-flow fan 192 is discharged in a cylindrical direction of the cross-flow fan 192 and guided into the bottom compartment.

The guided air passes through the discharge port 202 of the discharge grill 200. At this time, the air is discharged into the space for an air conditioning by the vain 204 and the louver 206 installed in the inside of the discharge port 202.

Like this, since air is introduced into the indoor unit from a plurality of directions, the heat exchange efficiency is improved and the air conditioning for the entire indoor space is rapidly achieved.

It will be apparent to those skilled in the art that various modifications and variations can be made in the present invention. Thus, it is intended that the present invention covers the modifications and variations of this invention provided they come within the scope of the appended claims and their equivalents.

First, the connection groove 222 can be formed at the front frame 120, and the connection rib 240 and the connection protrusion 246 can be formed at the suction grill 140. Then, they are connected together. Alternatively, the connection groove 222 can be formed at the suction grill 140 and the connection rib 240 can be formed at the front frame 120.

Also, although the connection rib 240 is formed by partially cutting a portion of the suction grill 140, a separate connection rib can also be formed from the lower portion of the suction grill 140 or the side thereof.

In addition, for the connection of the filter 180 and the suction grill 140, the connection protrusion 249 is formed at the suction grill 140 and the corresponding connection ring 184 is formed at the filter 180. Alternatively, the connection ring 184 can be formed at the suction grill 140 and the corresponding connection protrusion 249 can be formed at the filter 180.

Further, by forming a plurality of protrusions only at the filter 180 without forming the connection ring 184 at the suction grill 140, or by forming a plurality of protrusions only at the suction grill 140, the suction grill 140 and the filter 180 can be connected together. For example, instead of the connection ring 184 of the filter 180, a protrusion such as the locking protrusion 182 is placed at a position of the connection ring 184. In this manner, like the locking protrusion 182, the left/right rib 231 of the suction grill 140 is closely attached to this protrusion. In this case, the upper left/right rib 231 of the suction grill 140 is closely attached to the lower surface of the locking protrusion 182. The lower left/right rib 231 of the suction grill 140 is closely attached to the upper surface of the protrusion, such that the filter 180 and the suction grill 140 are integrated as one body.

Furthermore, when the lower portion of the filter 180 is fixed using the lower rib 186 formed at the lower portion of the filter 180, the suction grill 140 can be mounted on the front frame 120.

As described above, according to the indoor unit of the air conditioner of the present invention, the suction grill and the filter are combined together by a connection means and then are attached to the front frame. That is, the filter and the suction grill can be easily combined together by the connection protrusion, the connection ring and the locking protrusion, which are formed in the filter and the suction grill. The assembly of the filter and the suction grill can be attached to and detached from the filter frame at the same time. Accordingly, when assembling and disassembling the suction grill and the filter, the working efficiency can be improved and the after service and the cleaning can be easily achieved.

The suction grill is detachably connected to the front frame. Since the suction grill is easily disassembly, the suction grill and the indoor unit can be easily cleaned, thereby providing easy after service.

In assembling and disassembling the suction grill, since the suction grill is slidably attached and detached on the front frame and the elastic connection rib is provided at the lower portion of the suction grill. Consequently, the suction grill can be easily attached and detached. In other words, in assembling the suction grill, the suction grill is closed attached to the front frame and then pushed upward. The suction grill is automatically assembled. In disassembling the suction grill, the suction grill is moved laterally by applying a predetermined force to the connection rib and is pulled downward. By doing so, the suction grill is completely disassembled. Consequently, the working efficiency can be improved.

The indoor unit of the air conditioner is installed at a high position of the building. Since the suction grill is attached or detached while sliding downward, the suction grill can be easily cleaned.

Since the air is introduced from the front, upward and rear of the indoor unit of the air conditioner and then discharged downward, the air is smoothly circulated in the indoor space, thereby improving the performance of the air conditioner.

What is claimed is:

1. An indoor unit of an air conditioner, comprising:

a main chassis forming a rear appearance;

a front frame disposed at a front of the main chassis to form a front appearance;

a front panel covering a front of the front frame, indoor air being sucked through side edges of the front panel;

a heat exchanger disposed between the main chassis and the front frame;

a fan for generating airflow through the heat exchanger;

a suction grille detachably mounted at the front frame and covering at least a suction part formed at an upper surface of the front frame;

a filter disposed at a front of the front frame, for filtering foreign particles from air; and a connection rib extending from a lateral end of the suction grille, the connection rib being elastically deformed while the suction grille moves along the front frame.

2. The indoor unit according to claim 1, further comprising:

a connection protrusion which extends from a side of the connection rib; and a connection groove which is depressed at a surface of the front frame for receiving the connection projection.

3. The indoor unit according to claim 2, wherein the connection rib is elastically deformed while the suction grille slides along the front frame and returns to an original state when the connection projection is received in the connection groove.

4. The indoor unit according to claim 2, wherein the connection rib includes:

a support part extending from an end portion of the suction grille; and a guide part bent from an end portion of the support part.

5. The indoor unit according to claim 4, wherein the connection protrusion is protruded laterally in the support part.

6. The indoor unit according to claim 4, wherein a guide protrusion is protruded in the guide part so as to prevent a sliding.

7. The indoor unit according to claim 1, wherein the front frame includes a sliding support surface for guiding a sliding of both ends of the suction grille.

8. The indoor unit according to claim 1, wherein the filter is fixed to the suction grille.

9. The indoor unit according to claim 8, wherein the suction grille and the filter are attached to and detached from the front frame at a time.

10. The indoor unit according to claim 8, wherein the suction grille and the filter are fixed by a plurality of protrusions formed in at least one of the suction grille and the filter.

11. The indoor unit according to claim 8, wherein the filter surrounds a front of the front frame and a portion of a rear thereof.

12. The indoor unit according to claim 8, wherein the filter includes a lower rib at a lower portion, the lower rib being fixed to the front frame.

13. The indoor unit according to claim 1, wherein suction grille and the filter includes a connection protrusion and a connection ring connected together.

14. The indoor unit according to claim 1, wherein the main chassis includes a rear suction hole, through which air is introduced, at a rear surface.

15. The indoor unit according to claim 14, wherein the rear suction hole is provided in plurality at an upper portion of the main chassis.

16. The indoor unit according to claim 1, wherein the front panel is spaced apart from the front frame by a predetermined distance such that the indoor air is sucked through the side edges of the front panel.

* * * * *